US006021721A

United States Patent [19]

Rushton

[11] Patent Number: 6,021,721

[45] **Date of Patent: *Feb. 8, 2000**

[54] PALLET

[75] Inventor: Lawrence David Rushton, Clitheroe, United Kingdom

[73] Assignee: World Wide Pallets Limited, Lancashire, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,405

[22] PCT Filed: Mar. 13, 1996

[86] PCT No.: PCT/GB96/00573

§ 371 Date: Apr. 9, 1998

§ 102(e) Date: Apr. 9, 1998

[87] PCT Pub. No.: WO96/28358

PCT Pub. Date: Sep. 19, 1996

[30] Foreign Application Priority Data

Mar. 14, 1995 [GB] United Kingdom ..... 9505086

[51] Int. Cl.[7] ..... B65D 19/00

[52] U.S. Cl. ..... 108/56.3; 108/56.1; 108/901

[58] Field of Search ..... 108/56.1, 56.3, 108/57.25, 57.26, 901, 902

[56] References Cited

U.S. PATENT DOCUMENTS

| | | | |
|---|---|---|---|
| 3,678,868 | 7/1972 | Hirota | 108/901 X |
| 3,868,915 | 3/1975 | Hafner | 108/901 X |
| 4,597,338 | 7/1986 | Kreeger | 108/56.1 X |
| 4,799,433 | 1/1989 | Luft | 108/56.1 X |
| 5,197,395 | 3/1993 | Pigott et al. | 108/56.1 |
| 5,388,533 | 2/1995 | Pigott et al. | 108/56.1 X |
| 5,483,899 | 1/1996 | Christie | 108/56.3 |
| 5,497,709 | 3/1996 | Gonzalez et al. | 108/56.3 |
| 5,579,686 | 12/1996 | Pigott et al. | 108/56.1 |
| 5,579,701 | 12/1996 | Fook Wah | 108/56.1 |
| 5,704,300 | 1/1998 | Rushton et al. | 108/56.1 |

FOREIGN PATENT DOCUMENTS

| | | |
|---|---|---|
| 0 564 989 | 10/1993 | United Kingdom . |
| 0 583 796 | 2/1994 | United Kingdom . |
| WO A 94 20377 | 9/1994 | WIPO . |
| WO A 94 22728 | 10/1994 | WIPO . |

*Primary Examiner*—Peter M. Cuomo
*Assistant Examiner*—Hanh V. Tran
*Attorney, Agent, or Firm*—Workman, Nydegger & Seeley

[57] ABSTRACT

A load-handling pallet includes a load bearing platform, a base member, and a plurality of block elements. The block elements are arranged to interconnect the load bearing platform to the base member. In one embodiment, snap-fit connections are provided between the block elements and both the platform and the base member. The snap-fit connections are arranged to be engaged by a movement perpendicular to the plane of the platform. The snap-fit connection is facilitated by inserting spigots, projecting from opposing sides of the block elements, within apertures formed in the platform and base member.

19 Claims, 2 Drawing Sheets

PALLET

The present invention relates to a pallet comprising a plurality of releasably-connected components of plastics material.

International Patent Application WO94/22728 discloses a pallet comprising a plurality of such components interconnected by bolt members. The present invention seeks to provide an arrangement providing the advantages of ease of repair and maintenance and of hygiene while employing fewer components and improving ease of assembly.

Accordingly, in one aspect, the invention provides a load-handling pallet comprising means defining a load-bearing platform, means defining a base member, and at least four block elements arranged to interconnect the platform and the base member, in which snap-fit connections are provided between the block elements and at least one of the platform and the base member, the snap-fit connections being arranged to be engaged by a movement perpendicular to the plane of the platform.

The block elements are preferably connected to both the platform and the base member by means of snap-fit connections. The snap-fit connections on each block element preferably comprise engaging portions mounted on the ends of spigots extending in opposite senses in the direction perpendicular to the plane of the platform.

The engaging portions of the spigots are arranged to be connected to apertures in the platform and the base member. The apertures are preferably located so that, when connected, the ends of the spigots do not project beyond the upper surface of the platform and/or the lower surface of the base member. This avoids snagging and reduces the accumulation of dirt.

Preferably the platform comprises a plurality of decking boards arranged on two or three cross-members. In this case, the engaging portions of the spigots are preferably connected to apertures located in the cross-members, the arrangement being such that the ends of the spigots do not project beyond the upper surfaces of the cross-members, and the decking boards are arranged to cover the apertures.

In a preferred arrangement, and according to another aspect of the invention, the decking boards slide into corresponding dove-tail portions on the cross-members, with corresponding engagement formations being provided at the crossing points, each said engagement formation comprising a dimple element on one of the decking board or cross-member and a matching recess on the other. This has the advantage of quickly and accurately locating the decking boards, whilst still permitting quick and easy release if subsequently required.

A preferred embodiment of the present invention will now be described, by way of example only, with reference to the accompanying drawings, of which:

Figure 1:
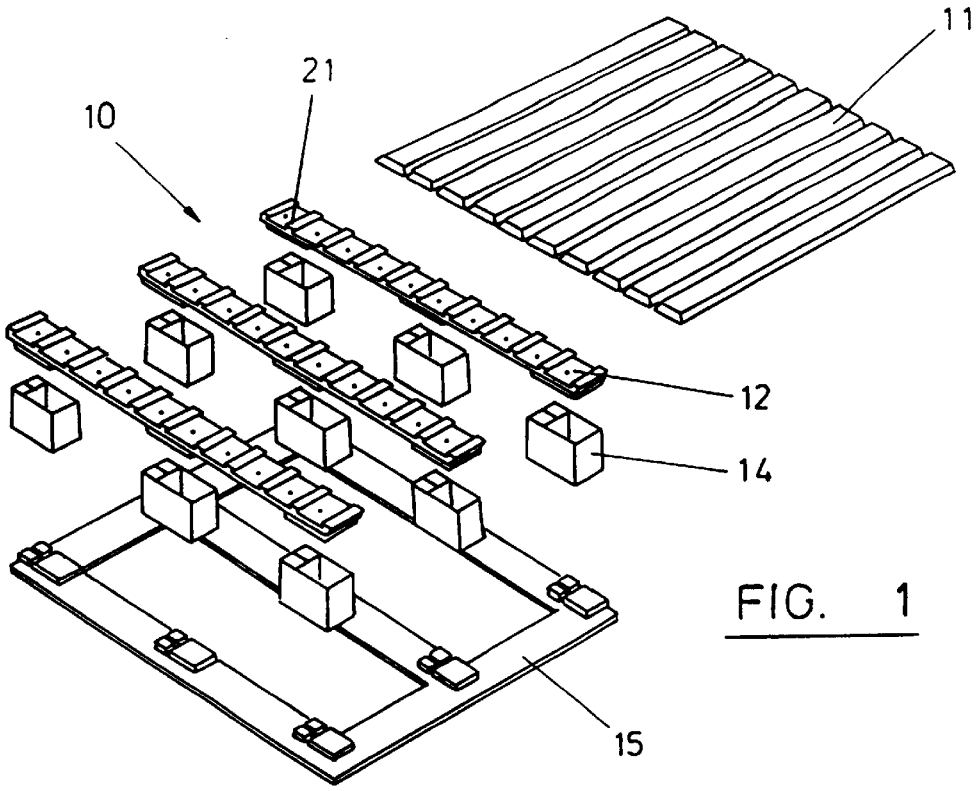
FIG. 1 shows an exploded view of a pallet in accordance with the present, invention.

Referring to the drawings, a pallet 10 comprises ten separate decking boards 11, three stringers or cross-members 12, nine spacer blocks 14 and a base frame 15. All twenty three components are preferably made of injection-moulded-high density foamed polyethylene or other suitable plastics material. The stringers 12 are attached to the tops of spacer blocks 14 by snap-fit connections, and the bottoms of the spacer blocks are attached to the base frame 15 by further snap fit connections. The decking boards 11 slide into respective dove-tailed grooves 21 and the tops of stringers 12. The components of the pallet may be assembled and disassembled in any desired order.

Figure 2:
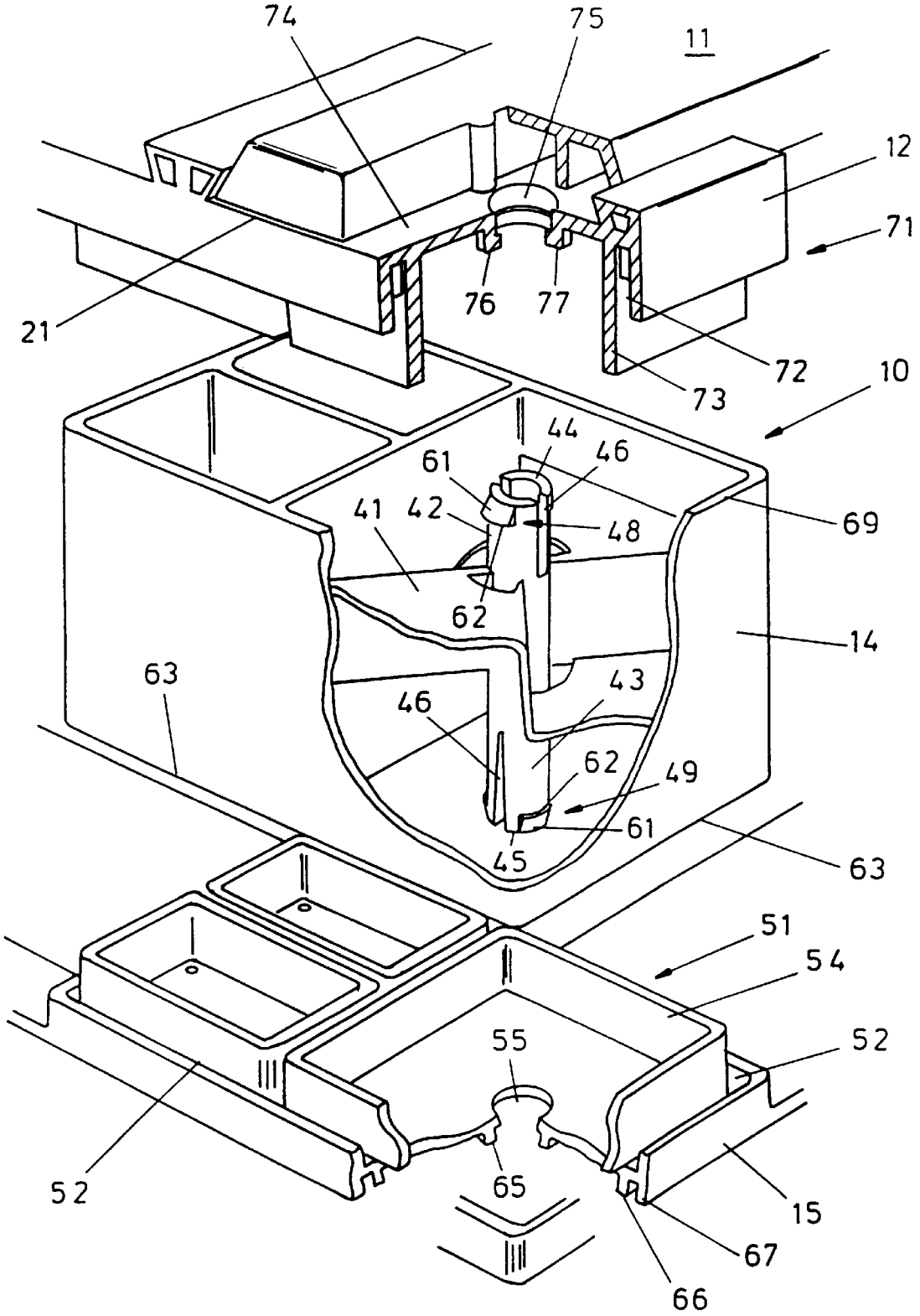
FIG. 2 shows a partly cut-away view on an enlarged scale of a corner of the pallet of FIG. 1 before assembly.

FIG. 2 shows an enlarged view of a corner block 14, partly sectioned to show the snap-fit connections with a stringer 12 and the base frame 15. Block 14 is open-ended and substantially hollow and has an internal diagonal spar 41 extending at about mid-height level. Extending upwardly and downwardly from the central region of spar 41 are hollow spigot members 42, 43. To permit the spigot ends 44, 45 to flex, there are provided diametrically-opposed extended notches 46, with a length greater than the diameter of the spigots. To provide the snap-fit connections, the ends of the spigots are provided with diametrically-opposed nose portions 48, 49, located substantially orthogonally to the notches 46. The nose portions each have a sloping face 61 terminating in a locking shoulder 62 extending substantially perpendicularly to the cylindrical spigot outer wall.

Base frame 15 is provided with a recessed tray-like region 51 at its corner having a peripheral groove 52 which is arranged to receive the bottom edges 63 of the block 14. Square portion 54 has a central aperture 55. On the downwardly facing surface of the region 51, aperture 55 is surrounded by a circular wall 65. Wall 65 is spaced from the aperture 55 by a distance equal to, or slightly greater than, the depth of shoulders 62 on the lower spigot member 43.

The bottom of frame 15 has peripheral projections 66, 67 which is rests on the ground. The height of wall 65 is equal to, or slightly smaller than the height of projections 66, 67 so that the wall engages or is slightly spaced from the ground. The height of wall 65 is also substantially equal to the height of nose portions 49 on the lower spigot member.

Stringer 12 has a region 71 with a peripheral groove 72 which is arranged to receive the top edge 69 of block 14. The top wall 74 of square portion 73 of the region 71 in provided with a through aperture 75. A circular wall 76 surrounds aperture 75 at a distance equal to, or slightly greater than, the depth of shoulder 62 on the upper spigot member 42. At the free edge of wall 76 there is provided a circumferential flange 77 which projects inwardly by a distance substantially equal to the depth of shoulders 62 on the upper spigot member 42. The height of wall 76 is substantially equal to the height of nose portion 48 on the upper spigot member.

To assemble the pallet, edge 63 of block 14 is inserted in groove 52 and the end 45 of spigot member 43 is inserted into aperture 55. The two halves of the spigot end flex inwardly and then nose portions 49 snap outwardly to fit within the space defined by wall 65 and the bottom surface of portion 54. The end 45 of the spigot member lies flush with the end of wall 65, i.e. in contact with or spaced slightly above the ground.

Another step in the assembly, which can occur before, after or simultaneously with the previous step is the attachment of block 14 to stringer 12. This occurs by inserting top edge 69 of the block into groove 72 of the stringer and the end 48 of upper spigot member 42 into aperture 75 to form a snap-fit connection as described in the preceding paragraph. In this case, however, the nose portions 48 lie completely below top wall 74 so that the end surface of the spigot member 42 lies flush with the surrounding surface of wall 74.

Figure 3:
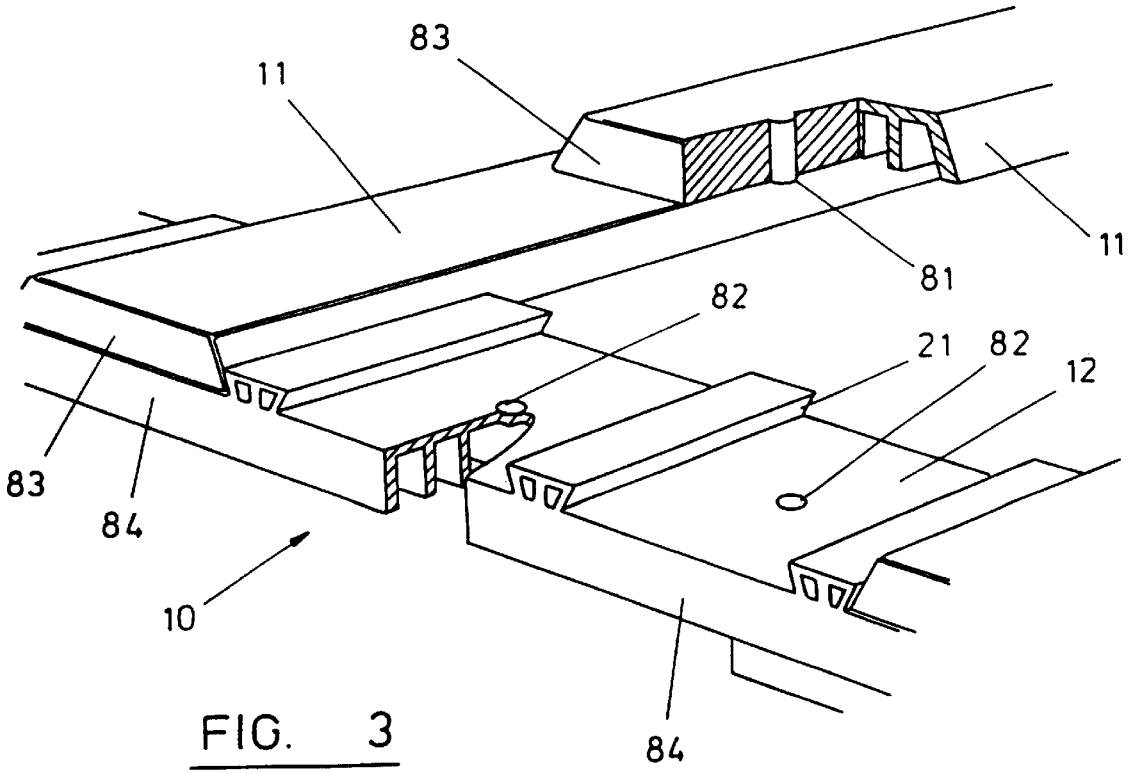
FIG. 3 shows a similar view of one end of the load-bearing platform of the pallet.

FIG. 3 shows a view of the interconnection between a stringer 12 and the decking boards 11. As in WO94/22728, the interconnection is achieved by means of dovetail joints. However, as location means there are provided three spaced pips 81 on the underside of each decking board at the position where they cross the three stringers 12. At corresponding locations, the stringers are provided, with dimples 82 to receive the pips 81.

During assembly the decking board is slid into the groove 21 of stringer 12, and when it is in its precise location, pip 81 snaps into dimple 82. In the case of the end stringers, this is when the end face 83 of the decking board is aligned with the stringer side face 84. The pips and dimples further serve to retain the decking board 11 in its precise location. However, a sufficiently strong pull will release them for disassembly.

The above-described embodiment has the advantages of quick and easy assembly and subsequent disassembly, whilst using a minimal number of components. All visible surfaces are smooth and so the disadvantages of snagging and of unhygienic crevices are avoided. In particular the various interconnections between the various components are out of sight.

Since the top spigot connections lie flush with the top surface of the stringers, they do not interfere with the smooth insertion of the decking members. As for the bottom spigot member, where there is no such requirement, this extends through and beyond aperture 55 which gives a stronger connection.

Various modifications can be made to the above-described embodiment. In particular the direction of the snap fit connections between the blocks 14 and the stringers and/or base frame could be made in the plane of the platform instead of perpendicular thereto.

Although the top spigot surface preferably lies flush with the top surface of the stringer, it can be recessed if desired.

The central stringer 12 and/or the central limb of the base frame 15 may be omitted if desired. Indeed base frame 15 can be omitted entirely. Additional decking boards 11, stringers 12, and blocks 14 may be provided if desired for larger or stronger pallets. In addition the snap-fit connections between the blocks 14 and the stringers and/or the base frame may be supplemented by locking pins or bolts etc; if so, these pins need to be removed before disassembly.

I claim:

1. A load-handling pallet which comprises:

(a) a load-bearing platform having a bottom surface with a plurality of apertures formed thereon and a peripheral groove at least partially encircling each aperture, (b) means defining a base member, and (c) at least four block elements arranged to interconnect the platform and the base member, each block element including a collar attached to and at least partially encircling an upward facing spigot, one end of the collar terminating at a top edge, each upward facing spigot being directly received in a snap-fit connection within a corresponding aperture of the load bearing platform such that the top edge of the corresponding collar is received within the peripheral groove encircling the corresponding aperture, the snap-fit connections being arranged to be engaged by a movement perpendicular to the plane of the platform.

2. A pallet as claimed in claim 1, in which the platform comprises a plurality of releasably connected components of plastics material.

3. A pallet as claimed in claim 1, in which the connections between the block elements and both (a) the platform and (b) the base member are provided by snap-fit connections.

4. A pallet as claimed in 1, in which the collar of each block element also at least partially encircles a downward facing spigot.

5. A pallet as claimed in claim 1, wherein each peripheral groove and each top edge of the collars have complementary polygonal configurations.

6. A pallet as claimed in claim 1, in which each block carries two spigots extending in opposite directions, for engaging the platform and the base member respectively.

7. A pallet as claimed in claim 6, further comprising a plurality of apertures formed on the base member and a peripheral groove at least partially encircling each aperture, each aperture on the base member being configured to snap-fit connect with the spigot of a corresponding block element.

8. A pallet as claimed in claim 1, in which the platform comprises a plurality of decking boards and at least two crossmembers on which the decking boards are supported.

9. A pallet as claimed in claim 8, in which the apertures of the load bearing platform are formed on the crossmembers.

10. A pallet as claimed in claim 9, in which the apertures in the crossmembers are arranged so that the ends of the spigots do not protrude above the upper surfaces of the crossmembers.

11. A pallet as claimed in claim 9, in which the decking boards cover the apertures in the upper surface of the crossmembers.

12. A pallet as claimed in claim 9, in which the decking boards engage the crossmembers by means of mating dove-tail portions, the decking boards and the crossmembers having mating dimple elements and pips at their crossing points.

13. A load-handling pallet as recited in claim 1, wherein the loadbearing platform includes a pair of spaced apart walls projecting from the bottom surface thereof, the pair of spaced apart walls bounding at least a portion of the peripheral groove therebetween.

14. A load-handling pallet comprising:

(a) a load bearing platform having a bottom surface with a plurality of apertures formed therein, a peripheral groove at least partially encircles each of the apertures on the bottom surface of the platform;

(b) a base frame integrally molded as a single unit from a material comprised of plastic, the base frame having a plurality of apertures formed therein; and (c) a plurality of space blocks each having a tubular collar attached to and at least partially encircling an upward facing spigot and a downward facing spigot, one end of the tubular collar terminating at a top edge, each upward facing spigot being configured to be received in a snap-fit connection within a corresponding aperture of the load bearing platform such that the top edge of the corresponding collar is received within the peripheral groove encircling the corresponding aperture, each downward facing spigot being configured to be received within a corresponding aperture of the base frame such that each downward facing spigot directly interlocks with the base frame in a snap-fit connection.

15. A load-handling pallet as recited in claim 14, wherein the load bearing platform comprises:

(a) a plurality of elongated stringers each having a bottom surface with the apertures formed therein and a top surface having a plurality of dove-tail grooves formed thereon; and (b) a plurality of deck boards, each deck board being configured to slide within a corresponding dove-tail groove.

16. A load-handling pallet as recited in claim 15, wherein each elongated stringer is integrally molded as a single unit from a material comprised of plastic.

17. A load-handling pallet as recited in claim 14, wherein each peripheral groove and each top edge of the tubular collars have complementary polygonal configurations.

18. A load-handling pallet as recited in claim 14, wherein each tubular collar terminates at an opposing bottom edge and each aperture on the base frame is at least partially encircled by a peripheral groove, the bottom edge of the each collar being received within a corresponding peripheral groove on the base frame when a corresponding downward facing spigot is received within the corresponding aperture.

19. A load-handling pallet comprising:

(a) a plurality of elongated stringers each having a bottom surface and an opposing top surface, the top surface having a plurality of dove-tail grooves formed thereon, the bottom surface having a plurality of apertures formed thereon, each aperture being at least partially encircled by a peripheral groove;

(b) a plurality of space blocks mounted to the bottom surface of the elongated stringers, each space block including a collar attached to and at least partially encircling an upward facing spigot, one end of the collar terminating at a top edge, each upward facing spigot being received in a snap-fit connection within a corresponding aperture of the stringer such that the top edge of the corresponding collar is received within the peripheral groove encircling the corresponding aperture; and (c) a plurality of deck boards, each deck board being configured to be slideably received within corresponding dove-tail grooves on the stringers.

* * * * *